US005584751A

United States Patent [19]

Kobayashi et al.

[11] Patent Number: 5,584,751

[45] Date of Patent: Dec. 17, 1996

[54] WAFER POLISHING APPARATUS

[75] Inventors: Hiroyuki Kobayashi; Hiroo Miyairi; Osamu Endo, all of Omiya, Japan

[73] Assignee: Mitsubishi Materials Corporation, Tokyo, Japan

[21] Appl. No.: 607,603

[22] Filed: Feb. 27, 1996

[30] Foreign Application Priority Data

Feb. 28, 1995 [JP] Japan ..... 7-041076

[51] Int. Cl.[6] ..... B24B 5/00

[52] U.S. Cl. ..... 451/288; 451/287; 451/398; 451/41

[58] Field of Search ..... 451/285, 286, 451/287, 288, 397, 398, 41

[56] References Cited

U.S. PATENT DOCUMENTS

| | | | |
|---|---|---|---|
| 4,519,168 | 5/1985 | Cesna | 451/41 |
| 5,205,082 | 4/1993 | Shendon et al. | 451/398 |
| 5,449,316 | 9/1995 | Strasbaugh | 451/287 |

FOREIGN PATENT DOCUMENTS

| | | | |
|---|---|---|---|
| 354058294 | 5/1979 | Japan | 451/289 |
| 359187456 | 10/1984 | Japan | 451/288 |
| 363052967 | 3/1988 | Japan | 451/288 |
| 405069310 | 3/1993 | Japan | 451/41 |
| 406015563 | 1/1994 | Japan | 451/287 |

*Primary Examiner*—Bruce M. Kisliuk
*Assistant Examiner*—George Nguyen
*Attorney, Agent, or Firm*—Armstrong, Westerman, Hattori, McLeland & Naughton

[57] ABSTRACT

A wafer polishing apparatus increases the polishing uniformity by adjusting an abutting pressure of a retainer ting to an optimum value. A wafer holding head 32 of this apparatus has a head body 34, a carrier 46 provided within the head body 34, a retainer ring 50 arranged on the outer periphery of the carrier 46, a diaphragm 44 for pressing the carrier 46, a ring-shaped tube 54 which is made of an elastic material and mounted between the head body 34 and the retainer ring 50, and a second pressure regulating mechanism 60 for regulating a pressure of a fluid filled within the tube 54.

11 Claims, 4 Drawing Sheets

WAFER POLISHING APPARATUS

BACKGROUND OF THE INVENTION

1. Field of Invention

The present invention relates to a wafer polishing apparatus, and more particularly, to an improvement for increasing uniformity of a polishing amount of a wafer surface.

2. Description of Related Art

As a wafer polishing apparatus of this type, an apparatus has been widely known which comprises a disc-like platen having a polishing pad affixed to the surface thereof; a plurality of wafer holding heads holding one surface of the water to be polished to abut the other surface of the water against the polishing pad; and a head driving mechanism for relatively rotating the wafer holding heads with respect to the platen, and which performs polishing by supplying a slurry containing polishing powders between the polishing pad and the wafer.

As an improvement to the apparatus of this type, U.S. Pat. No. 5,205,082 discloses a water holding head as shown in FIG. 6. The wafer holding head includes a hollow head body 1, a diaphragm 2 stretched in the horizontal position within the head body 1, and a carrier 4 fixed to the lower surface of the diaphragm 2. This water holding head is of a floating head construction in which the carrier 4 can be pressed downward by supplying pressurized air from a pressurized air source 10 to an air chamber 6 formed by the diaphragm 2. Such a floating head construction has an advantage in its capability to equalize an abutting pressure of the wafer against the polishing pad.

A retainer ring 12 is arranged concentrically on the outer periphery of the carrier 4. The retainer ring 12 is also fixed to the diaphragm 2. The lower end of the retainer ring 12 protrudes downward below carrier 4, thereby holding the outer periphery of the wafer adhered to the lower surface of the carrier 4. Thus, by holding the outer periphery of the wafer, the problem in which the wafer is removed from the carrier 4, can be prevented. In addition, it is believed that a phenomenon in which a polishing amount at the outer peripheral portion of the wafer becomes larger than that of at the center portion of the wafer can be prevented by polishing the wafer with the wafer surrounded by the retainer ring 12, and with the lower end of the retainer ring 12 allowed to be flush with the lower surface of the wafer.

Conventionally, it has been considered that an excessive polishing of the outer peripheral portion of the wafer can be prevented simply by arranging the lower end surface of the retainer ring 12 to be substantially flush with the surface of the water to be polished, as described above.

However, as a result of an extensive study made by the present inventors on the wafer polishing apparatus, a novel phenomenon is found in which, with some materials of the polishing pad, a polishing pad P locally swells along the inner peripheral edge of a portion thereof abutted against the retainer ring 12 (hereinafter, referred to as "waving deformation"), as shown in FIG. 7. Accordingly, an outer peripheral portion G of a wafer W is excessively polished by this swelling portions T, whereby the polishing uniformity of the wafer W is hindered. In addition, it is also found by the present inventors that when the phenomenon occurs, the above-described waving deformation can be prevented by setting an abutting force of the retainer ring 12 against the polishing pad P to a proper value which is smaller than conventially known, thereby substantially preventing the excessive polishing of the outer peripheral portion G of the wafer.

SUMMARY OF THE INVENTION

The present invention is made on the basis of the above findings, and has its object to provide a wafer polishing apparatus which can increase a polishing uniformity by adjusting an abutting pressure of a retainer ring to an optimum value.

To achieve the above object, a wafer polishing apparatus according to the present invention comprises: a platen having a polishing pad affixed to the surface thereof; one or more than one wafer holding heads holding one surface of the wafer to be polished to abut the other surface of the wafer against the polishing pad; and a head driving mechanism polishing the other surface of the wafer with the polishing pad by relatively moving the wafer holding head with respect to the platen, wherein the water holding head includes a head body; a disc-like carrier provided within the head body for holding the one surface of the wafer to be polished; a retainer ring arranged concentrically on the outer periphery of the carrier for abutting against the polishing pad when polishing and holding the outer periphery of the wafer; a carrier pressure regulating mechanism for pressing the carrier toward the platen side in such a manner that a pressure can be regulated; and a ring pressure regulating mechanism provided independently of the carrier pressure regulating mechanism for pressing the retainer ring toward the platen side in such a manner that a pressure can be regulated.

In the wafer polishing apparatus according to the present invention, an abutting pressure of the retainer ring against the polishing pad can be regulated by operating the ring pressure regulating mechanism provided separately from the carrier pressure regulating mechanism, thereby preventing the waving deformation of the polishing pad so as to prevent an excessive polishing of the outer peripheral portion of the wafer.

As described above, in the wafer polishing apparatus according to the present invention, the abutting pressure of the retainer ring against the polishing pad can be regulated by operating the ring pressure regulating mechanism provided separately from the carrier pressure regulating mechanism. Therefore, it is possible to prevent the waving deformation of the polishing pad so as to prevent the excessive polishing of the outer peripheral portion of the water.

In addition, when the tube or diaphragm is used to control the fluid pressure, the abutting pressure of the retainer ring against the polishing pad becomes constant over the entire abutting surfaces thereof. Therefore, an excessive abutting pressure is not generated locally, and even a local generation of waving deformation can be prevented.

DETAILED DESCRIPTION OF THE INVENTION

FIGS. 1 to 4 show a first embodiment of a wafer polishing apparatus according to the present invention.

Figure 1:
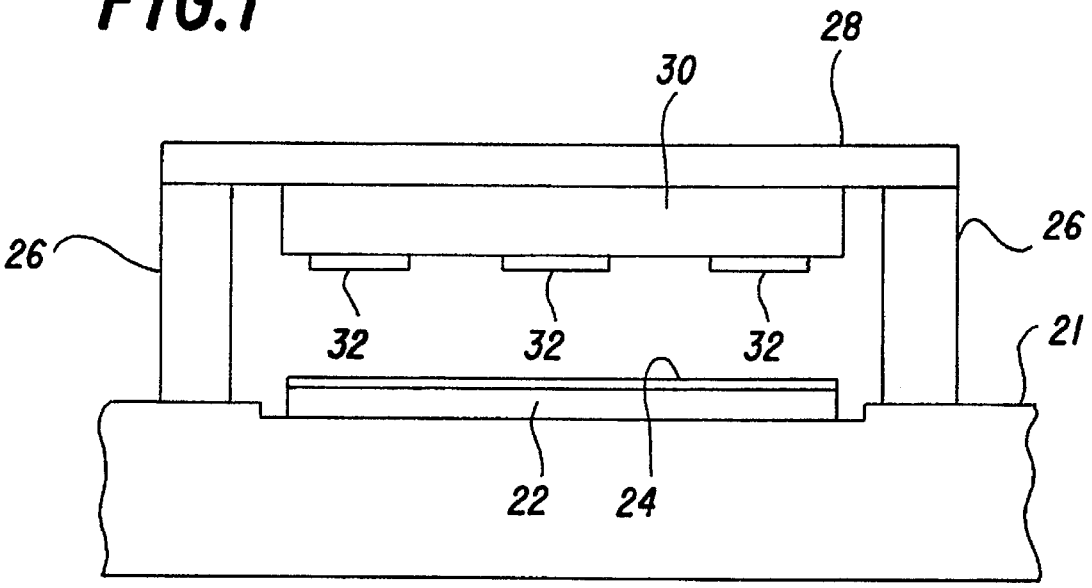
FIG. 1 is a front view showing a first embodiment of a wafer polishing apparatus according to the present invention.

First, the entire configuration will be described briefly with reference to FIG. 1. Referring to Fig. 1, there is provided a base 21, and a disc-like platen 22 is mounted on the center of the base 21 in the horizontal position. The platen 22 is so constructed as to rotate around its axis by a platen drive mechanism provided within the base 21, and a polishing pad 24 is affixed to the entire top surface thereof.

Figure 2:
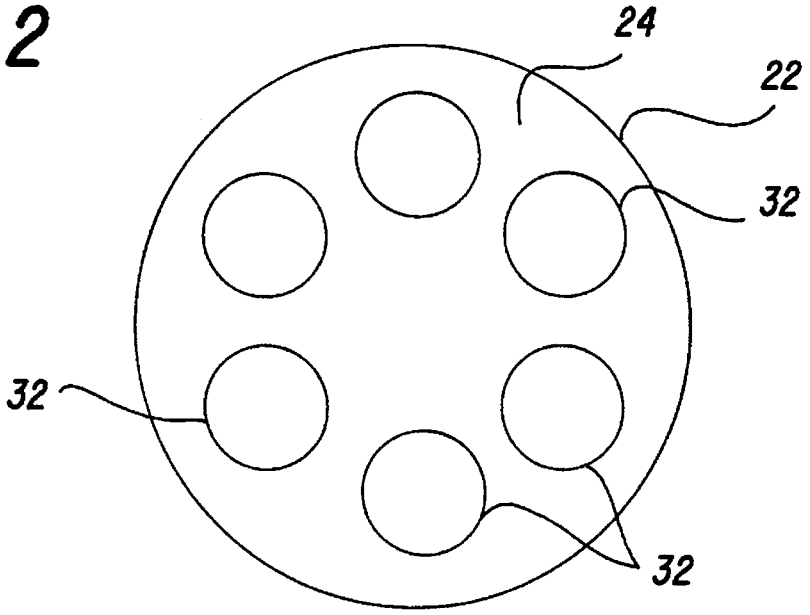
FIG. 2 is a plan view showing an arrangement of wafer holding heads and a platen of the apparatus.

An upper side mounting plate 28 is fixed above the platen 22 in the horizontal position through a plurality of columns 26. A disc-like carousel (head driving mechanism) 30 is fixed to the lower surface of the upper side mounting plate 28. The carousel 30 is provided with six wafer holding heads 32 each facing with the platen 22. These wafer holding heads 32 are equally arranged at every 60° around a center axis of the carousel 30 in the same distance from the center of the carousel 30, as shown in FIG. 2, and the wafer holding heads 32 are planetarily rotated, by means of the carousel 30. The number of the wafer holding heads 32 is not limited to six. One to five, or more than six wafer holding heads may be provided.

Figure 3:
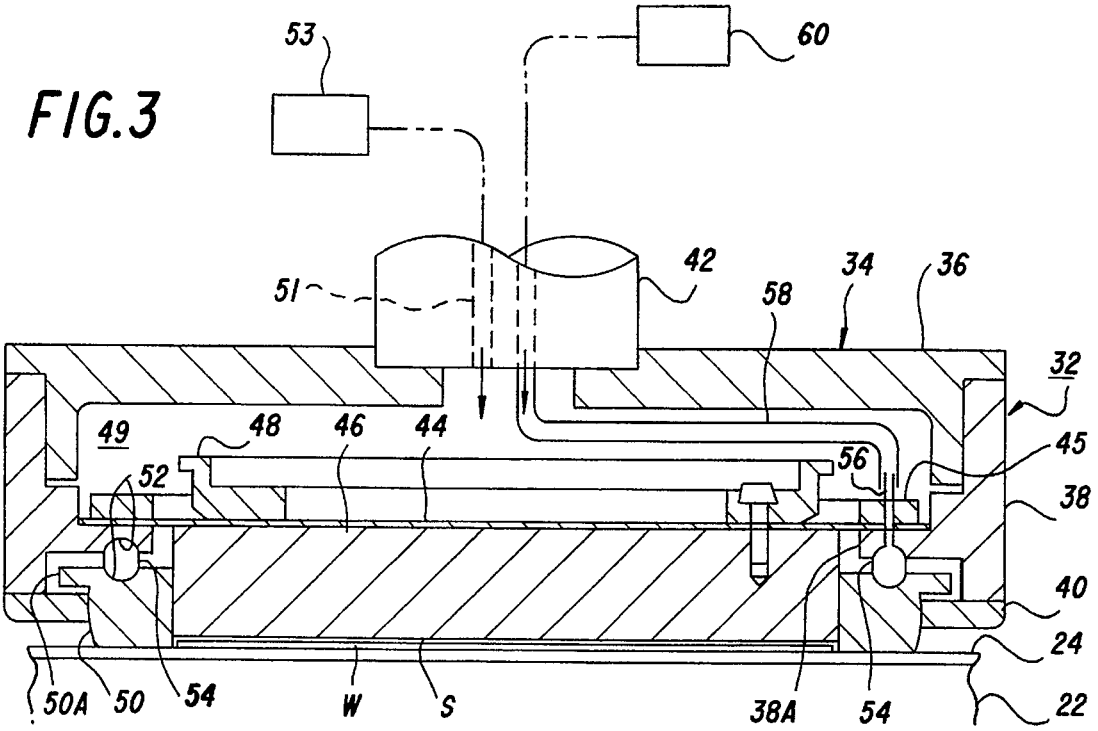
FIG. 3 is a sectional view showing a wafer head of the apparatus of the first embodiment.
Figure 4:
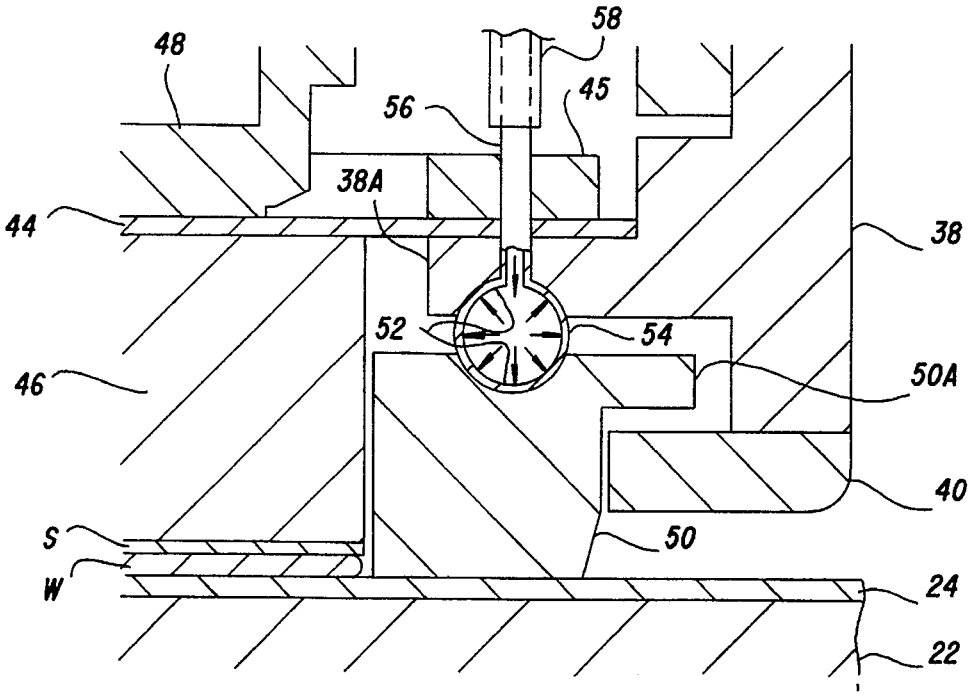
FIG. 4 is an enlarged view of a main part of FIG. 3.

Next, a single wafer holding head 32 will be described with reference to FIGS. 3 and 4. As shown in FIG. 3, the wafer holding heads 32 comprises a hollow head 34 which is arranged perpendicular to the axis and having an opening at the lower end thereof, a diaphragm 44 stretched inside the head body 34, a carrier 46 fixed to the lower surface of the diaphragm 44, and a retainer ring 50 arranged concentrically on the outer periphery of the carrier 46.

The head body 34 consists of a disc-like top plate 36 and a cylindrical-shaped peripheral wall 38 fixed to the outer periphery of the top plate 36. The top plate 36 is coaxially fixed to the shaft 42 of the carousel 30. A ring-shaped mounting portion 38A protruding radially inward is formed on the entire inner peripheral surface of the peripheral wall 38 over the whole inner circumference thereof. The outer periphery of the disc-like diaphragm 44 is placed on the mounting portion 38A and fixed by a fixing ring 45. The diaphragm 44 is formed of elastic materials, and may be any of various types of rubbers, for example. A first passage 51 is formed in the shaft 42, and a fluid chamber 49, formed by the head body 34 and diaphragm 44, is connected to a first pressure regulating mechanism 53 through the first passage 51. By regulating a fluid pressure in the fluid chamber 49 with the first pressure regulating mechanism 53, the diaphragm 44 is moved up and down so that the pressure of the carrier 46 exerted on the polishing pad 24 is changed. Generally, air is sufficient to use as a fluid. However, other kinds of gasses or liquids may be used, as needed.

The carrier 46 is formed of a material having a high rigidity such as a ceramic, and having a fixed thickness. It is not deformable elastically. The carrier 46 is fixed to the fixing ring 48 which is coaxially arranged on the upper surface of the diaphragm 44 by means of a plurality of bolts. A flange spreading outward is formed on the upper end of the fixing ring 48. When the head moves upward, the flange is held by a holding member (not shown) so as to support the weight of the carrier.

The retainer ring 50 has a flat ring-shaped lower end surface, and is concentrically arranged with a minimal clearance between the outer peripheral surface of the carrier 46. The retainer ring 50 is displaceable up and down independently of the carrier 46. A holding portion 50A, which protrudes radially outward, is formed on an upper peripheral edge of the retainer ring 50, as shown in FIG. 4. When the water holding head 32 is pulled up from the platen 22 together with the carousel 30, the holding portion 50A will be held by a stopper 40 fixed to the lower end of the peripheral wall 38.

Grooves 52, each being formed into a concentric ring with respect to the head axis and having a circular arc-shaped cross-sectional configuration, are formed on the lower surface of the mounting portion 38A of the head body 34 and on the upper surface or the retainer ring 50, respectively, at a position in which they face each other. A ring-shaped tube 54 is disposed between the grooves 52. The tube 54 may be bonded to the inner surfaces of the grooves 52. Materials of the tube 54 are not restricted. Specifically, however, the tube 54 is formed of elastic materials such as various types of rubber or elastomers. The inside of the tube is hollow over the whole circumference thereof. When a fluid is charged into the tube, the cross section thereof expands circularly, whereby a diameter of the cross section is changed according to the inner pressure thereof. Although there is no restriction of the tube 54 from a viewpoint of materials, the tube 54 is preferably capable of resisting the inner pressure of at least 5 $kg/cm^2$. The cross-sectional configuration of the tube 54 is not limited to circular, and it nay be oval and the like. Two or more tubes may be concentrically arranged so as to be in communication with each other.

A pipe 56, connected to a part of the tube 54, passes through the fixing ring 45, diaphragm 44 and mounting portion 38A. A second passage 58 is connected to the upper end of the pipe 56 so as to be connected to a second pressure regulating mechanism 60 through the shaft 42. By regulating a fluid pressure in the tube 54 with the second pressure regulating mechanism 60, an abutting pressure of the retainer ring 50 against the polishing pad 24 is changed while being maintained uniformly over the entire abutting surface thereof.

When a polishing is performed, a wafer w is adhered to the lower surface of the carrier 46 through a wafer adhering sheet. The wafer adhering sheet S is formed of a material having water absorption properties such as a nonwoven fabric, and the wafer adheres to the adhering sheet S by the surface tension of the water absorbed into sheet S. A specific example of materials of the wafer adhering sheet S includes various types of nonwoven fabrics and the like each having preferably a thickness of 0.6 to 0.8 mm. However, the wafer adhering sheet S is not necessarily used in the present invention. For example, the wafer W may be adhered through a wax provided on the lower surface of the carrier 46, or other adhering means may be used.

According to the wafer polishing apparatus described above, a control of the second pressure regulating mechanism 60 enables the inner pressure of the tube 54 to be regulated, whereby the abutting pressure of the retainer ring 50 against the polishing pad 24 can be regulated. Thus, a waving deformation, caused by a swelling around a portion of the polishing pad 24 abutting against the retainer ring, is prevented. This can prevent an excessive polishing of the outer peripheral portion of the wafer W in order increase uniformity of polishing. According to experiments conducted by the present inventors, it is found that a wafer polishing uniformity reaches a maximum when the abutting pressure of the retainer ring 50 against a common polishing pad 24 is a fixed value within a range of 0.7 to 1.7 times of the abutting pressure of the wafer W (generally, 6 psi or more) against the polishing pad 24. When the abutting pressure of the wafer W against the polishing pad 24 is less than 6 psi, the above range may be preferably 1.7 to 2.4 times.

In addition, since the tube 54 is shaped into a ring, and has a fixed cross-sectional configuration, the abutting pressure of the retainer ring 50 against the polishing pad 24 is constant over the entire abutting surfaces thereof. Therefore, an excessive abutting pressure is not generated locally, and even a local generation of the waving deformation can be prevented.

Furthermore, the grooves 52 are formed on the mounting portion 38A and the retainer ring 50, respectively, and the tube 54 is fitted between the grooves. Thus, the position of the tube 54 is not displaced radially even if it is expanded, thereby preventing a generation of nonuniform pressure due to displacement.

The polishing pad 24 may include a two layers, including a hard surface layer abutting against the wafer W, and an elastic supporting layer located between the hard surface layer and the platen 22. Such a two-layer type polishing pad offers a specific effect in increasing the polishing accuracy of a wafer, as described below. At the same time, however, it has a tendency to cause the problem illustrated in FIG. 7 more remarkably than a single-layer type polishing pad. Therefore, when the two-layer type polishing pad is combined with the present invention, both effects cooperate together to offer a particularly excellent effect in increasing a polishing accuracy of the wafer. However, it can be understood that the present invention is not limited only to such two-layer type polishing pad. The two-layer type polishing pad will now be specifically described.

The Shore hardness of the hard surface layer is preferably 80 to 100, and more preferably, 90 to 100. The Shore hardness of the elastic supporting layer is preferably 50 to 70, and more preferably, 50 to 65. The thickness of the hard surface layer is preferably 0.5 to 1.5 mm, and more preferably, 0.8 to 1.3 mm. The thickness of the elastic supporting layer is preferably 0.5 to 1.5 mm, more preferably, 1.0 to 1.3 mm.

As the hard surface layer and elastic supporting layer, an expanded polyurethane and a nonwoven fabric may be preferably used, respectively. Particularly, the expanded polyurethane is preferably used for the hard surface layer, and the nonwoven fabric such as polyester is preferably used for the elastic supporting layer. When the hard surface layer and elastic supporting layer are formed of the nonwoven fabric, an impregnant such as a polyurethane resin may be impregnated therein. However, the polishing pad 24 may be formed of a material other than the above described materials if it has a hardness satisfying the above-described range.

When this type of two-layer polishing pad is used, it offers an excellent effect in wafer polishing, particularly in the technology for separating an insulating film. This type of the technology for separating an insulating film is such that aluminum or the like to be used for writing is deposited on the mirror finished surface of the water to form a circuit pattern, an insulating film such as $SiO_2$ is laminated thereon by BPSG, PTEOS, or CVD method, and thereafter, the insulating layer is flattened by polishing to form thereon the inner structure of elements.

In the case of polishing the above insulating film, initial irregularities due to the circuit pattern may be present on the surface of the wafer. In the two-layer type polishing pad, however, the surface of the pad is formed by a relatively hard surface layer. Thus, the surface of the polishing pad 24 is scarcely elastically deformed following the irregularities. Therefore, a generation of difference in level after polishing due to the initial irregularities can be reduced.

In addition, the hard surface layer which directly abuts against the wafer W is elastically supported by the elastic supporting layer from the back side thereof. Thus, an equalizing action of the wafer abutting pressure by the floating type head 32 and a cushion effect by the elastic supporting layer cooperate together to offer an effect of deforming the hard surface layer, even if the polishing pad 24 or the wafer W swells, along the swelling to abut uniformly over the entire surface of the wafer W. This equalizes a polishing speed of the wafer W by the polishing head 24, thus reducing non-uniformity of the thickness of the wafer after polishing, and simultaneously achieving the reduction of differences in level and the improvement of thickness uniformity, which are conventionally difficult to be compatible.

Figure 7:
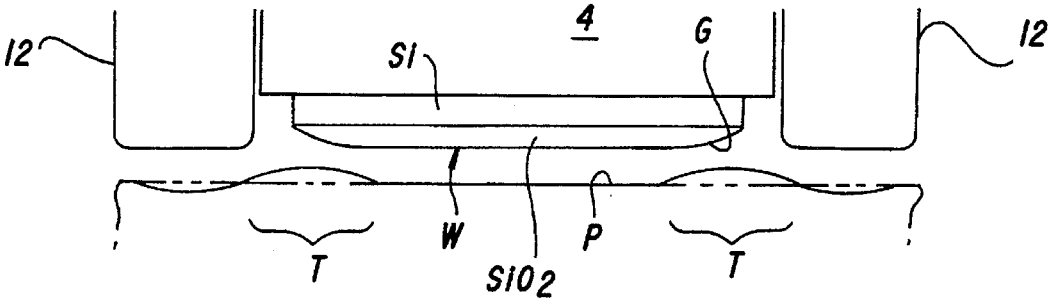
FIG.7 PRIOR ART
FIG. 7 is a schematic diagram showing a problem of the conventional apparatus.

Furthermore, according to the two-layer type polishing pad as described above, the hard surface layer is backed by the soft elastic supporting layer. Thus, when the hard surface layer is pressed strongly by the retainer ring 50, there will be a great tendency for the circumference of the pressing portion to wave and swell, as shown in FIG. 7. Therefore, the regulation of the abutting pressure of the retainer ring 50 with the tube 54 can effectively prevent the waving deformation, thereby sufficiently offering the effect of the two-layer type polishing pad.

Figure 5:
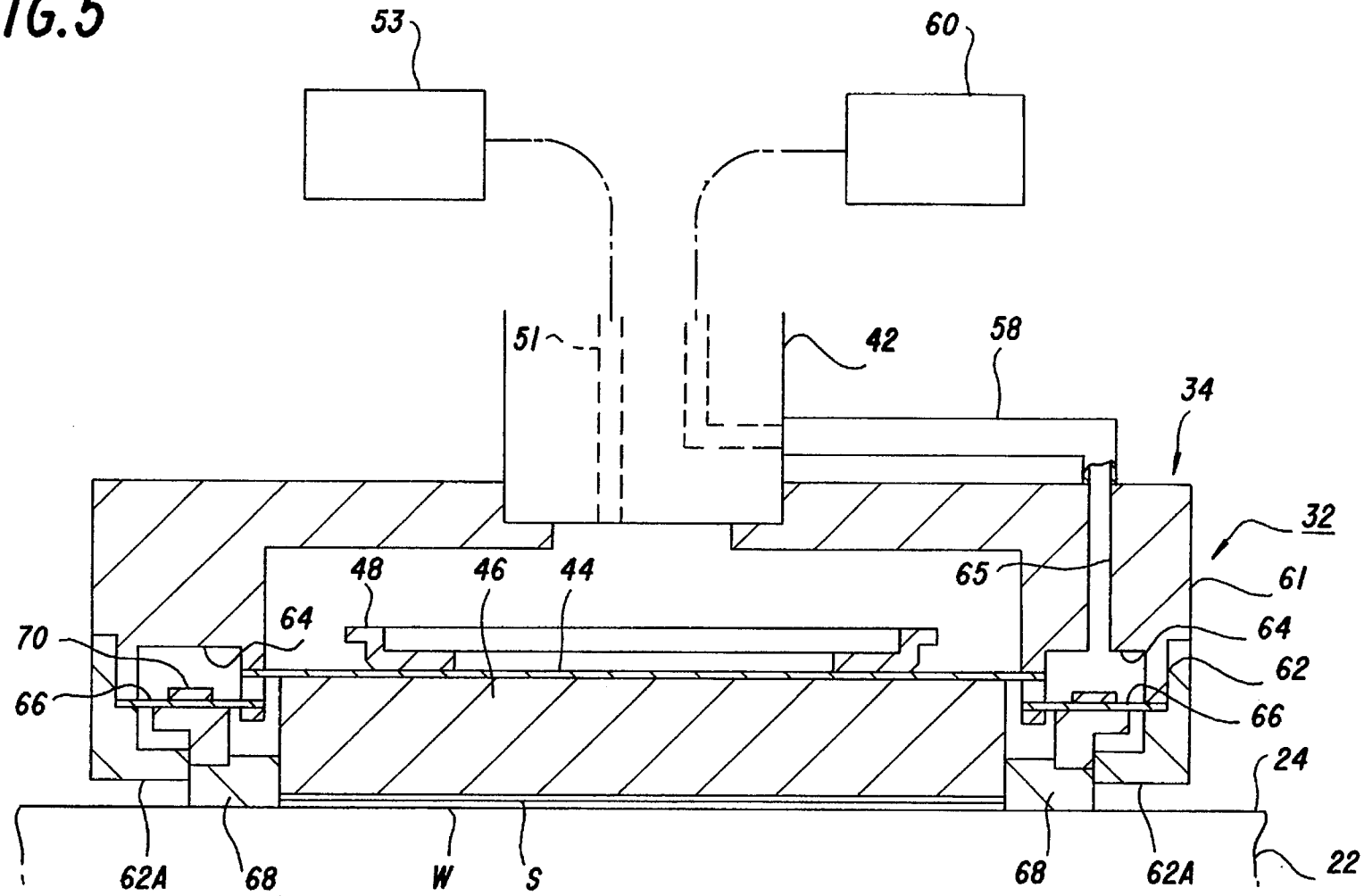
FIG. 5 is a sectional view showing a water holding head used in a second embodiment of the present invention.
Figure 6:
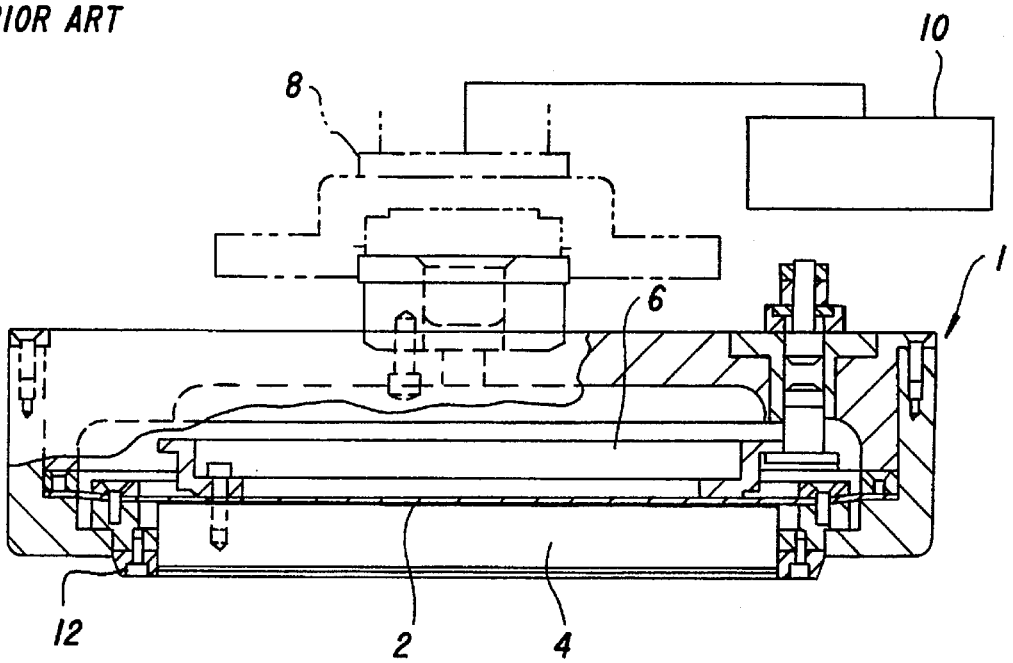
FIG.6 PRIOR ART
FIG. 6 is a sectional view showing a wafer holding head of a conventional wafer polishing apparatus.

FIG. 5 is a sectional view showing a wafer holding head 32 of the second embodiment of the wafer polishing apparatus according to the present invention. This embodiment differs from the first embodiment in that a second diaphragm 66 is used in place of the tube 54. The same components are indicated by the same reference numerals, as in the prior embodiment, in order to omit the description thereof.

A head body 34 of this embodiment is mainly composed of the upper part 61 and the lower part 62. A ring-shaped second fluid chamber 64 is formed concentrically with the head axis on the lower end surface of the upper part 61. A ring-shaped second diaphragm 66 is stretched in the horizontal position over the whole circumference thereof at the lower end of the second fluid chamber 64, thereby sealing the second fluid chamber 64 to be air-tight. The second diaphragm 66 may be formed of the same materials as those of the diaphragm 44, such as various types of rubber or elastomers. However, these materials are not limited to those described above. On the other hand, a second passage 65 which opens in the second fluid chamber 64 is formed within the upper part 61. The second passage 65 is further connected to a second pressure regulating mechanism 60 through the second passage 58 and shaft 42.

A retainer ring 68 is concentrically arranged on the outer periphery of the carrier 46 in such a manner that it can move up and down. The upper end of the retainer ring 68 is abutted against the center of the second diaphragm 66 and secured by a plurality of screws or the like to the fixing ring 70, arranged concentrically on the second diaphragm 66. The width of the upper end portion of the retainer ring 68 fixed to the second diaphragm 66, and the width of the fixing ring 70 are reduced to some extent compared with the deformable width range of the second diaphragm 66, and are constant over the whole circumference thereof, respectively, so that a pressing force of the retainer ring 68 due to the second diaphragm 66 can be adjusted while maintaining the pressing force uniformly over the whole circumference thereof.

A flange spreading radially outward is formed on the upper end of the retainer ring 68. When the wafer holding head 32 is pulled up from the platen 22, the flange will be held by a stopper 62A formed on the lower end of the lower part 62.

According to the embodiment as described above, the control of the second pressure regulating mechanism 60 for regulating the fluid pressure within the second fluid chamber 64 enables the abutting pressure of the retainer ring 68 against the polishing pad 24 to be regulated. Thus, a waving deformation caused by a swelling around an abutting portion of the polishing pad 24 against the retainer ring 68, is prevented. This can prevent an excessive polishing of the outer peripheral portion of the wafer W and increase uniformity of polishing.

In addition, according to this embodiment, the second fluid chamber 64 and the second diaphragm 66 are used. This offers such an advantage that the wide range of pressure regulation can be set by varying the size of each parts.

The present invention is not limited to the above two embodiments, and various changes and modifications may be made. For example, a pressing means employing a magnetic force and an electrostatic force in place of a fluid pressure may be used as the ring pressure regulating mechanism. In addition, the carrier pressure regulating mechanism is not limited to a configuration in which the diaphragm is employed. Furthermore, in each of the above embodiments, the wafer holding head 32 is provided on the upper side and the platen 22 is provided on the lower side. However, they are not limited to that configuration and they may be inverted or arranged in a configuration in which they are oriented horizontally with respect to one another rather than vertically.

We claim:

1. A wafer polishing apparatus, comprising:

a platen having a polishing pad affixed to a surface thereof;

at least one wafer holding head for holding a first surface of the wafer to be polished and to abut a second surface, opposite said first surface, of the wafer against said polishing pad; and a head driving mechanism for polishing the second surface of the wafer with said polishing pad by relatively moving said wafer holding head with respect to said platen, wherein said wafer holding head includes, (a) a head body, (b) a disc-like carrier provided within said head body for holding said first surface of the wafer to be polished, (c) a retainer ring disposed concentrically on an outer periphery of the carrier for abutting against said polishing pad when polishing and holding an outer periphery of the wafer, (d) a carrier pressure regulating mechanism for regulating a pressing force of said carrier toward said platen, and (e) a ring pressure regulating mechanism provided independently of said carrier pressure regulating mechanism for regulating a pressing force of said retainer ring toward said platen.

2. A wafer polishing apparatus according to claim 1, wherein said wafer holding head is of a floating type, and wherein said carrier pressure regulating mechanism includes, a diaphragm stretched inside said head body, perpendicular to a head axis, and a first pressure regulating mechanism for regulating a fluid pressure filled in a fluid chamber formed between said diaphragm and said head body, and wherein said carrier is attached to said diaphragm.

3. A wafer polishing apparat us according to claim 1 or 2, wherein said ring pressure regulating mechanism includes, a ring-shaped tube made of an elastic body and mounted between said head body and said retainer ring, and a second pressure regulating mechanism for regulating a pressure of a fluid filled in said tube.

4. A wafer polishing apparatus according to claim 1 or 2, wherein said ring pressure regulating mechanism includes a ring-shaped second fluid chamber formed within said head body;

a ring-shaped second diaphragm constituting a wall of said second fluid chamber, and a second pressure regulating mechanism for regulating a pressure of a fluid filled in said second fluid chamber, and wherein said retainer ring is attached to said second diaphragm.

5. A wafer polishing apparatus according to claim 3, wherein said tube has a circular or oval cross-sectional configuration.

6. A wafer polishing apparatus according to claim 4, wherein said second diaphragm is stretched perpendicular to the head axis.

7. A wafer polishing apparatus according to claim 1 or 2, wherein said polishing pad includes a relatively hard surface layer for abutting against the wafer; and a relatively soft elastic supporting layer provided between said platen and said surface layer.

8. A wafer polishing apparatus according to claim 3, wherein said polishing pad includes a relatively hard surface layer for abutting against the wafer; and a relatively soft elastic supporting layer provided between said platen and said surface layer.

9. A wafer polishing apparatus according to claim 4, wherein said polishing pad includes a relatively hard surface layer for abutting against the wafer; and a relatively soft elastic supporting layer provided between said platen and said surface layer.

10. A wafer polishing apparatus according to claim 5, wherein said polishing pad includes a relatively hard surface layer for abutting against the wafer; and a relatively soft elastic supporting layer provided between said platen and said surface layer.

11. A wafer polishing apparatus according to claim 6, wherein said polishing pad includes a relatively hard surface layer for abutting against the wafer; and a relatively soft elastic supporting layer provided between said platen and said surface layer.

* * * * *